US005162619A

United States Patent [19]

Thiele et al.

[11] Patent Number: 5,162,619

[45] Date of Patent: Nov. 10, 1992

[54] DIAPHRAGM FOR A LOUDSPEAKER

[75] Inventors: Karl-Heinz Thiele, Peine; Jürgen Ehmann, Gundelsheim; Klaus Harbarth, Mosbach, all of Fed. Rep. of Germany

[73] Assignee: EWD Electronic-Werke Deutschland GmbH, Gundelsheim-Hochstberg, Fed. Rep. of Germany

[21] Appl. No.: 445,615

[22] PCT Filed: Jun. 30, 1988

[86] PCT No.: PCT/EP88/00570

§ 371 Date: Jan. 3, 1990

§ 102(e) Date: Jan. 3, 1990

[87] PCT Pub. No.: WO89/00372

PCT Pub. Date: Jan. 12, 1989

[30] Foreign Application Priority Data

Jul. 3, 1987 [DE] Fed. Rep. of Germany ..... 3722832
Dec. 29, 1987 [DE] Fed. Rep. of Germany ..... 3744356

[51] Int. Cl.[5] ..... H04R 7/02
[52] U.S. Cl. ..... 181/166; 181/170
[58] Field of Search ..... 181/166, 167, 170

[56] References Cited

U.S. PATENT DOCUMENTS 3,093,207 6/1963 Bozak .
3,285,364 11/1966 Cohen .
4,140,203 2/1979 Niguchi et al. ..... 181/167
4,190,746 2/1980 Harwood et al. ..... 181/170 X

FOREIGN PATENT DOCUMENTS 2541391 3/1977 Fed. Rep. of Germany .
2067239 8/1971 France .
2310053 11/1976 France .
0129616 11/1978 Japan ..... 181/170
0116000 7/1983 Japan ..... 181/170
1518285 7/1978 United Kingdom .
2112604 7/1983 United Kingdom .

*Primary Examiner*—Benjamin R. Fuller
*Assistant Examiner*—Gerald E. Preston
*Attorney, Agent, or Firm*—Spencer, Frank & Schneider

[57] ABSTRACT

A membrane for a loudspeaker is designed so as to facilitate manufacture and to improve the tone of the loudspeaker. The membrane consists of a first plastic film (5*a*) which serves to retain the shape and a second plastic film (56) laminated to the first film which serves to damper partial oscillations. The membrane is particularly suitable as a conical membrane for a loudspeaker for a television receiver.

5 Claims, 1 Drawing Sheet

DIAPHRAGM FOR A LOUDSPEAKER

BACKGROUND OF THE INVENTION

In a cone loudspeaker, the rearward end of the diaphragm is connected with the moving coil and, by way of a centering membrane, with the loudspeaker enclosure while its front end is connected with the loudspeaker enclosure by way of a bead. The centering membrane and the bead cause the diaphragm to be mobile as unimpededly as possible in the axial direction of the loudspeaker so as to produce the sound pressure but to be guided in the radial direction of the loudspeaker, i.e. to practically not move at all or as little as possible in this later direction. The diaphragm must here be connected with the bead along its forward circumferential edge.

The tone quality of a loudspeaker is here dependent, inter alia, on the proper functioning of the centering membrane and of the bead, as well as on the behavior of the diaphragm itself.

SUMMARY OF THE INVENTION

It is the object of the invention to configure the diaphragm of a loudspeaker in such a way that, on the one hand, the costs for glueing the diaphragm to the bead are reduced and the tone quality of the loudspeaker is improved.

The above object is generally achieved according to the present invention by a loudspeaker diaphragm which is formed of a two-layer material including a first plastic film, for providing form stabilization, having a second plastic film, for damping partial vibrations, applied or laminated to the first film, and with the diaphragm bean for connecting the diaphragm to a loudspeaker enclosure being a continuation of the same two-layer material. The modulus of elasticity of the first and second films is about $2.10^3$ N/mm$^2$ and 10–500 N/mm$^2$, respectively, and the thickness of the first and second films is about 200 $\mu$m$\pm$40 $\mu$m and 100 $\mu$m$\pm$50 $\mu$m, respectively.

In the solution according to the invention, the two films which together form the diaphragm, each by themselves perform different tasks. The first film, preferably composed of polycarbonate and having a relatively high modulus of elasticity, takes over the task of providing the required form stability of the diaphragm. It thus gives the diaphragm the stiffness required for distortion-free reproduction. The second, laminated film is configured as a thermal polyurethane film and serves to dampen partial vibrations of the diaphragm. Compared to the first film, it has a significantly lower modulus of elasticity. With such a two-layer diaphragm, requirements for form stability of the diaphragm, on the one hand, and damping of partial vibrations, on the other hand, can be met in such a way that the tone quality of the loudspeaker is improved. The second, thermal film preferably also extends over the outer edge region of the diaphragm and can therefore advantageously be additionally employed to simplify the process of glueing the bead to the diaphragm. The second, thermal film then serves to dampen partial vibrations in the diaphragm region and additionally for a hot sealing process or a hot pressing process in the edge region for fastening the bead to the diaphragm. The diaphragm according to the invention is particularly suitable for a cone loudspeaker in a television receiver.

BRIEF DESCRIPTION OF THE DRAWINGS

The invention will be described by way of embodiments thereof and reference to the drawing figures wherein in.

DETAILED DESCRIPTION OF THE PREFERRED EMBODIMENTS

Figure 1:
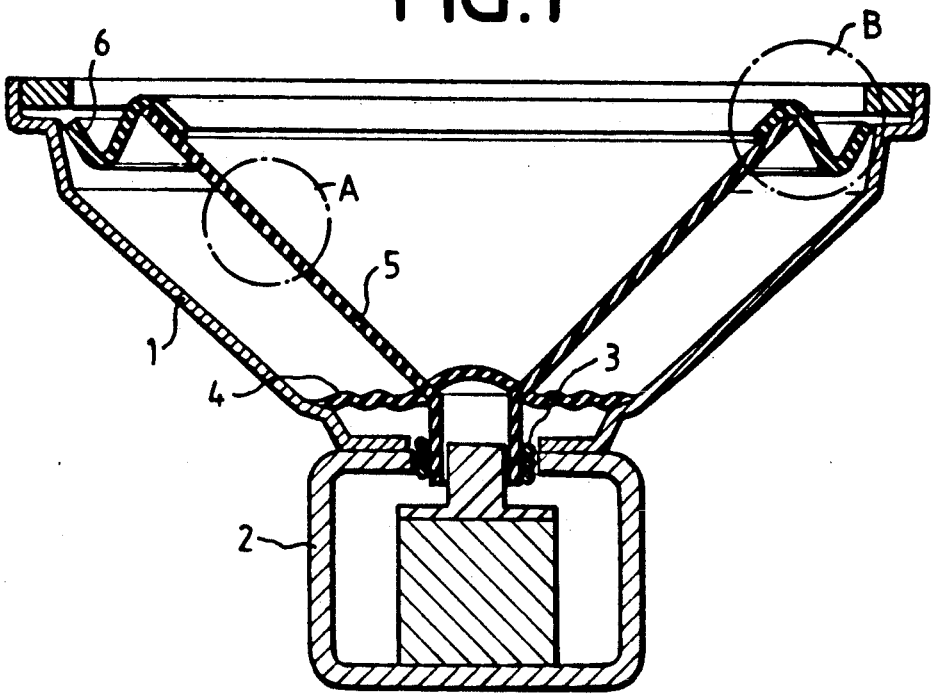
FIG. 1 is a schematic sectional view showing the structure of a cone loudspeaker.

FIG. 1 shows a loudspeaker including an enclosure 1, a magnet 2, a moving coil 3, a centering membrane 4, a conical diaphragm 5 and a bead 6. Centering membrane 4 and bead 6 are each connected with the edge of diaphragm 5 by means of a hot sealing process, a hot pressing process or by ultrasonic welding. The inner edge of centering membrane 4 is connected with moving coil 3 and the outer edge of bead 6 with enclosure 1.

Figure 2:
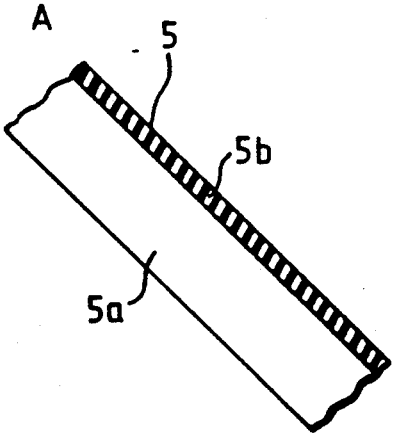
FIG. 2 is a partial sectional view of the cone diaphragm FIG. 1 at region "A"

FIG. 2 shows the structure of diaphragm 5. Diaphragm 5 is a shaped body composed of a first film 5*a* of relatively great thickness of about 250 $\mu$m; it is made of polycarbonate and has a modulus of elasticity of about $2\times10^3$ N/mm$^2$. A second film 5*b* is vapor-deposited onto the front of film 5*a*, i.e. the surface facing in the direction of sound propagation. Film 5*b* is a thermal polyurethane film having a thickness of about 50 $\mu$m and a modulus of elasticity of 10 to 500 N/mm$^2$. The second film 5*b* serves essentially to dampen the partial vibrations of diaphragm 5 in the upper edge region and simultaneously to establish a glue connection between bead 6 and diaphragm 5.

The starting material for the diaphragm, i.e. a film as shown in FIG. 2, has a great ability to be curved for a deep drawing process and is thus particularly suited for cone-type diaphragms.

In FIG. 1 it has been assumed that diaphragm 5 is connected with bead 6. This connection can preferably be effected by a hot glueing process or a hot pressing process while utilizing thermal layer 5*b* or by ultrasonic welding. Such a process is disclosed in the older Federal Republic of Germany patent application P DA-A-3,620,889 published Dec. 23, 1987. In the same manner, diaphragm 5 can also be connected with centering membrane 4.

Figure 3:
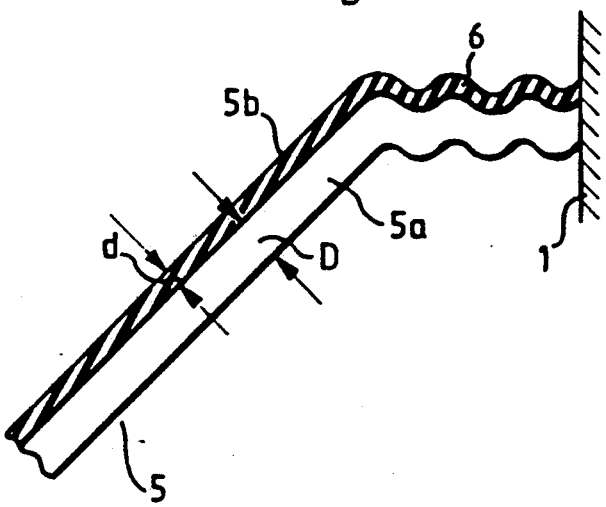
FIG. 3 is a partial sectional view showing another configuration of diaphragm and bead at region "B" of FIG. 1.

FIG. 3 shows another embodiment of the diaphragm and bead 6. In contrast to FIG. 1, diaphragm 5 and bead 6 are composed of the same, continuous material and are produced in one process step by deep drawing from a large-area material composed of the two films 5*a* and 5*b*. For this purpose, large plates, for example, of a width of about 1.2 m, are produced by laminating together the two films 5*a* and 5*b*. The generally thinner film 5*b* may also be rolled onto the thicker film 5*a*. The tone behavior of the loudspeaker equipped with a diaphragm 5 can be influenced as desired by changing the ratio between the thickness D of film 5*a* and the thickness d of film 5*b*. The thickness D of film 5*a* is, for example, 200 $\mu$m$\pm$40 $\mu$m and the thickness d of film 5*b* is 100 $\mu$m$\pm$50 $\mu$m. In the extreme case, the thickness ratio D/d can thus also lie in an order of magnitude of 1.

In the deep drawing process, the total thickness (D+d) may be smaller in the region of bead 6 than in the region of diaphragm 5, with preferably the thickness ratio D/d being the same for diaphragm 5 and bead 6.

We claim:

1. A loudspeaker diaphragm comprising: a shaped body of two-layer material including a first plastic film for providing form stabilization and a second plastic film applied thereto for damping partial vibrations, and a bead which connects an outer edge of the diaphragm shaped body with a loudspeaker enclosure, with said bead being a continuation of said two-layer material of the diaphragm shaped body, and wherein said first film has a modulus of elasticity of about $2 \cdot 10^3$ N/mm$^2$ and a thickness of about 200 $\mu$m$\pm$40 $\mu$m, and said second film has a modulus of elasticity of about 10 to 500 N/mm$^2$ and a thickness of about 100 $\mu$m$\pm$50 $\mu$m.

2. A diaphragm according to claim 1, wherein said first film is composed of polycarbonate.

3. A diaphragm according to claim 2, wherein said second film is composed of polyurethane.

4. A diaphragm according to claim 1, wherein said second film is composed of polyurethane.

5. A diaphragm according to claim 1, wherein said second film is applied only onto the front surface of the diaphragm which is oriented in the direction of propagation.

* * * * *